US008726460B2

(12) United States Patent
Jonsson et al.

(10) Patent No.: US 8,726,460 B2
(45) Date of Patent: May 20, 2014

(54) VACUUM CLEANER

(75) Inventors: Stefan Jonsson, Stockholm (SE); Henrik Nygren, Bromma (SE)

(73) Assignee: AB Electrolux (SE)

( * ) Notice: Subject to any disclaimer, the term of this patent is extended or adjusted under 35 U.S.C. 154(b) by 1303 days.

(21) Appl. No.: 12/524,507

(22) PCT Filed: Jan. 25, 2008

(86) PCT No.: PCT/SE2008/000071

§ 371 (c)(1),
(2), (4) Date: Apr. 27, 2010

(87) PCT Pub. No.: WO2008/091204

PCT Pub. Date: Jul. 31, 2008

(65) Prior Publication Data

US 2011/0017236 A1 Jan. 27, 2011

Related U.S. Application Data

(60) Provisional application No. 60/886,856, filed on Jan. 26, 2007.

(30) Foreign Application Priority Data

Mar. 2, 2007 (SE) ..... 0700542

(51) Int. Cl.

| | |
|---|---|
| ***A47L 9/10*** | (2006.01) |
| ***A47L 9/20*** | (2006.01) |
| ***B01D 45/18*** | (2006.01) |
| ***B01D 46/04*** | (2006.01) |

(52) U.S. Cl.
USPC ..... 15/352; 55/303

(58) Field of Classification Search
USPC ..... 15/352; 55/303
See application file for complete search history.

(56) References Cited

U.S. PATENT DOCUMENTS

| | | | | |
|---|---|---|---|---|
| 2,171,248 | A | 8/1939 | Van Berkel | |
| 5,951,746 | A | 9/1999 | Treitz et al. | |
| 2003/0121121 | A1* | 7/2003 | Nakai et al. | 15/352 |
| 2005/0011036 | A1* | 1/2005 | McCutchen | 15/319 |
| 2007/0056136 | A1* | 3/2007 | Stephens et al. | 15/351 |
| 2007/0125049 | A1* | 6/2007 | Menrik et al. | 55/337 |
| 2007/0209339 | A1* | 9/2007 | Conrad | 55/345 |

FOREIGN PATENT DOCUMENTS

| | | |
|---|---|---|
| DE | 1001465 | 1/1957 |
| WO | WO 8502528 | 6/1985 |
| WO | WO 2004100752 | 11/2004 |
| WO | WO 2005053497 | 6/2005 |

* cited by examiner

*Primary Examiner* — Bryan R Muller
(74) *Attorney, Agent, or Firm* — RatnerPrestia

(57) ABSTRACT

A vacuum cleaner having a vacuum source adapted to generate an airstream, a filter, a separating unit having a first sub-separator and a second sub-separator, and airflow passages to connect the vacuum source, the filter and the separating unit in a first configuration corresponding to a vacuum cleaning mode and a second configuration corresponding to a filter cleaning mode. In the vacuum cleaning mode, the airflow passages are configured to direct the airstream through the separating unit such that the airflow passes in parallel through the first sub-separator and the second sub-separator, then in a forward direction through the filter. In the filter cleaning mode, the airflow passages are configured to direct the airstream through the separating unit such that airflow passes in a reverse direction through the filter, and then through the separating unit such that the airflow passes in series through the first sub-separator and the second sub-separator.

9 Claims, 3 Drawing Sheets

VACUUM CLEANER

This application claims priority to International Application No. PCT/SE2008/000071 filed Jan. 25, 2008 (published as WO 2008/091204), which claims priority to both Swedish Patent Application No. SE 0700542-4 filed Mar. 2, 2007 and U.S. Provisional Application No. 60/886,856 filed Jan. 26, 2007, both of which are incorporated herein by reference.

TECHNICAL FIELD

The present disclosure relates to a vacuum cleaner that is switchable to filter cleaning mode in which the vacuum source is connected to the filter to force air through the filter in a reverse direction to remove dust from the filter, and a method for cleaning a vacuum cleaner filter.

BACKGROUND

It is known in the art to provide a vacuum cleaner having a separating unit, a vacuum source for creating a negative air pressure, and a downstream filter. Such a vacuum cleaner may be configured to operate in a vacuum cleaning mode, in which the vacuum source is connected to the separating unit to force a dust laden airstream therethrough in order to separate dust from the airstream, and the downstream filter is connected between the separating unit and the vacuum source to receive the airstream in a forward direction for filtering remaining dust therefrom. The vacuum cleaner may be switchable to a filter cleaning mode, in which the vacuum source is connected to the downstream filter to force an airstream therethrough in a reverse direction in order to remove dust from the downstream filter, and the separating unit is connected between the downstream filter and the vacuum source to remove dust, released by the downstream filter, from the airstream.

An example of such a vacuum cleaner is disclosed in WO 2005/053497 A1. In that document, two downstream filters are used, and when one is clogged by fine dust, the user may switch the places of the filters and clean the clogged filter using the separating unit and the other downstream filter. The cleaned filter is then ready for use when the other filter becomes clogged. One problem with this vacuum cleaner is that the user may forget cleaning the filter or may find the process somewhat cumbersome.

SUMMARY OF THE INVENTION

An exemplary object of the present disclosure is to wholly or partly obviate the problem described above. This object may be achieved by embodiments of the invention according to one or more of the appended claims.

In a first exemplary aspect, there is provided a vacuum cleaner having a vacuum source adapted to generate an airstream, a filter, a separating unit having a first sub-separator and a second sub-separator, and airflow passages to connect the vacuum source, the filter and the separating unit in a first configuration corresponding to a vacuum cleaning mode and a second configuration corresponding to a filter cleaning mode. In the vacuum cleaning mode, the airflow passages are configured to direct the airstream through the separating unit such that the airflow passes in parallel through the first sub-separator and the second sub-separator, then in a forward direction through the filter. In the filter cleaning mode, the airflow passages are configured to direct the airstream through the separating unit such that airflow passes in a reverse direction through the filter, and then through the separating unit such that the airflow passes in series through the first sub-separator and the second sub-separator.

In a second exemplary aspect, there is provided a vacuum cleaner having a vacuum source adapted to generate an airstream, the vacuum source having a vacuum source inlet and a vacuum source outlet, a filter having a front side and a back side, a separating unit comprising a first sub-separator having a first sub-separator inlet and a first sub-separator outlet, and a second sub-separator having a second sub-separator inlet and a second sub-separator outlet, and a dirty air inlet associated with an inlet nozzle. Airflow passages connect the vacuum source, the filter and the separating unit in a first configuration corresponding to a vacuum cleaning mode and a second configuration corresponding to a filter cleaning mode. In the vacuum cleaning mode, the airflow passages connect the dirty air inlet in parallel to the first sub-separator inlet and the second sub-separator inlet, connect the first sub-separator outlet and the second sub-separator outlet in parallel to the filter front side, and connect the filter back side to the vacuum source inlet. In the filter cleaning mode, the airflow passages connect the filter front side to the first sub-separator inlet, connect the first sub-separator outlet to the second sub-separator inlet, and connect the second sub-separator outlet to the vacuum source inlet.

In a third exemplary aspect, there is provided a method for operating a vacuum cleaner having a first sub-separator, a second sub-separator and a filter. The method includes a first mode of operation, including passing a first airstream through the first sub-separator and the second sub-separator in parallel to separate a first amount of dust from the first airstream, and passing the air stream leaving the first sub-separator and the second sub-separator through the filter in a forward direction for filtering a second amount of dust from the air stream. The method also includes a second mode of operation, including passing a second airstream through the filter in a backwards direction to remove a third amount of dust from the filter, then passing the second airstream through the first sub-separator and then the second sub-separator in series to remove a fourth amount of dust from the second airstream.

Other aspects and features are described more fully herein, and the present summary of the invention is not intended to limit the claimed invention in any way.

BRIEF DESCRIPTION OF THE DRAWINGS

Exemplary embodiments of the invention are described herein with reference to the attached drawings in which.

DETAILED DESCRIPTION OF EXEMPLARY EMBODIMENTS OF THE INVENTION

Figure 1:
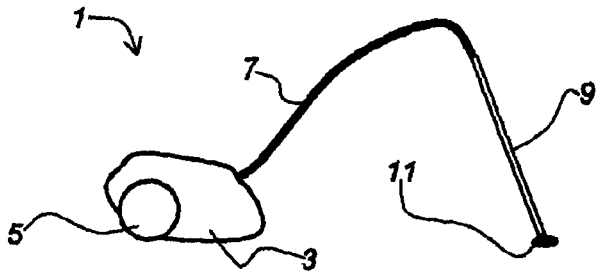
FIG. 1 shows a vacuum cleaner.

FIG. 1 shows a vacuum cleaner 1 of the canister or cylinder type. The vacuum cleaner comprises a main part 3, having a vacuum source and a separating unit (not shown). The main part may comprise wheels 5 to provide improved moveability, and may, via a flexible tube 7 and a stiff tube 9, be connected to a nozzle 11 that is capable of picking up dust from floors and carpets, etc.

The present disclosure is relevant also for upright types of vacuum cleaners, where the main part is provided integrated with the stiff tube, and for stationary vacuum cleaners which may be provided as fixed installations in buildings.

Figure 2:
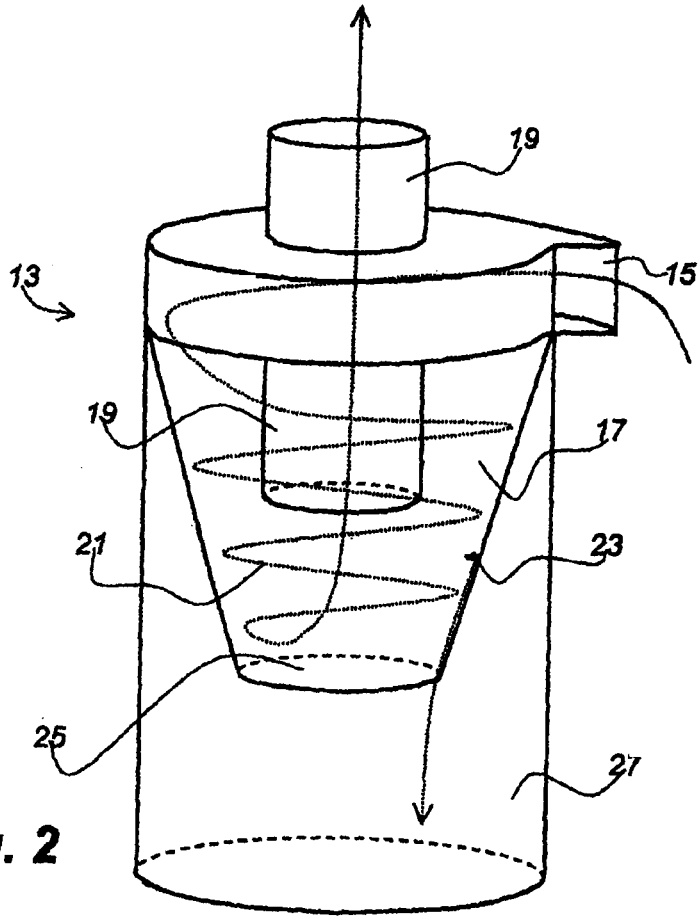
FIG. 2 schematically illustrates a cyclone.

FIG. 2 schematically illustrates a cyclone 13 which may be used as a separating unit in the vacuum cleaner of the present disclosure. The cyclone 13 has an inlet slot 15, through which dust laden air enters into a vortex chamber 17, which may have a substantially circular cross section perpendicularly to the vertical direction, as illustrated in FIG. 2. The dust laden air enters along a tangential direction at the periphery of the vortex chamber 17, and is sucked out of the vortex chamber 17 through an outlet tube 19, which is inserted in the centre of the vortex chamber 17. This makes the dust laden air flow in a vortex 21 through the vortex chamber 17. Dust particles 23 are therefore subjected to a centrifugal force generally according to the equation $V^2/R$, where V is the flow velocity and R is the diameter of the vortex chamber cross section, which forces the particles towards the vortex chamber side wall. Once a dust particle 23 reaches the wall, it is caught in a secondary airstream directed downwards in the figure, and falls through an opening 25 in the bottom part of the vortex chamber 17 and into a dust chamber 27.

The dust chamber 27 may be conveniently emptied by the user of the vacuum cleaner, and the use of a cyclone of this kind may obviate the need for conventional vacuum cleaner filter bags.

In the illustrated cyclone 13, the vortex chamber 17 has a cross-section which tapers in the downward direction and has a minimum cross section at the opening. More particularly, the vortex chamber has a frustoconical shape. However, it should be noted that other tapering forms as well as cylindrical, non-tapering forms may be considered in a cyclone.

Often, a cyclone or a separating unit of another type will have a trade-off between separation efficiency and flow resistance, the higher the efficiency the higher the resistance. Therefore, for example, if a cyclone capable of providing a very high separation efficiency/ratio for a standard dust would be used, the flow resistance would be too high to provide an acceptable airflow in the nozzle (11, FIG. 1) of the vacuum cleaner with a regular vacuum source. Therefore the vacuum cleaner would not be capable of picking up dust from a floor or a carpet in an acceptable manner. An example of a standard dust is DMT TEST DUST TYPE 8® referred to in DIN IEC 60312.

In practice therefore, a cyclone with a lower flow resistance is used, and any remaining dust which is sucked out through the outlet tube 19 is instead removed with a downstream filter in order to protect the vacuum source. Usually it is the finer dust fraction that remains to be filtered, as heavier particles are subjected to greater centrifugal forces. The term downstream filter refers to the filter being placed after the main separator but before the vacuum source in a vacuum cleaning mode.

There will now be described a vacuum cleaner with means for cleaning such a downstream filter, whereby clogging of the filter may be avoided to a great extent. To do so the vacuum cleaner is switched from the usual vacuum cleaning mode to a filter cleaning mode. This may be done manually or automatically.

Figure 3A:
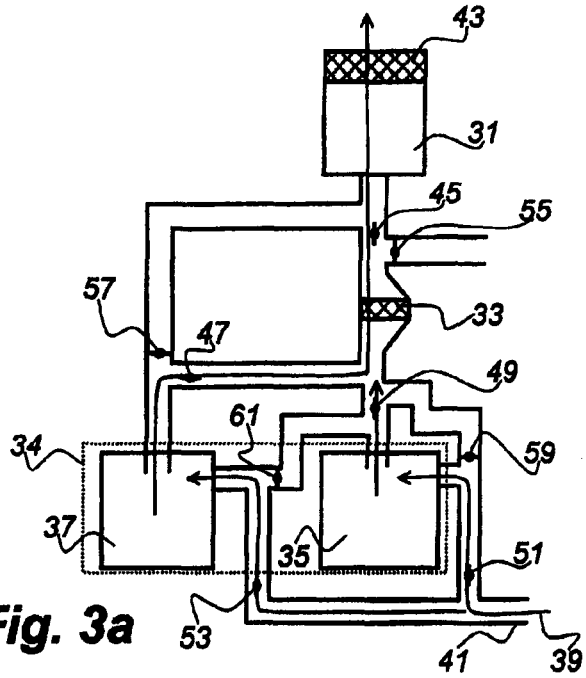
FIG. 3*a* schematically illustrates a vacuum cleaner operating in a vacuum cleaning mode.
Figure 3B:
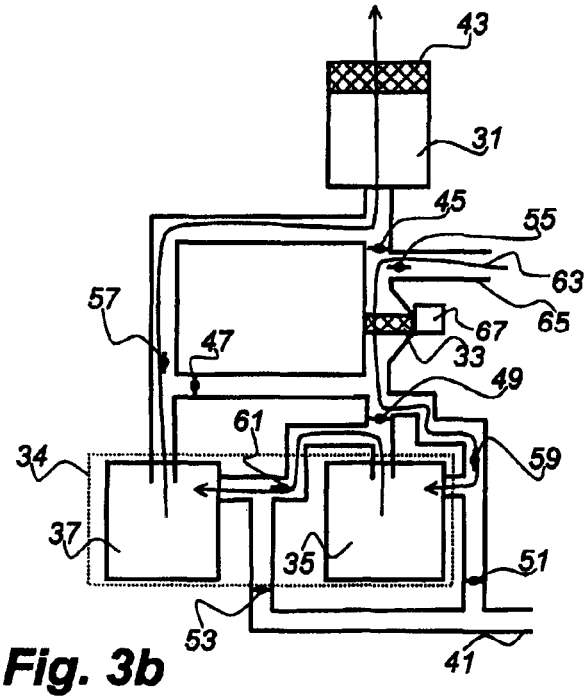
FIG. 3*b* schematically illustrates the vacuum cleaner of FIG. 3*a* in a filter cleaning mode.

FIG. 3*a* illustrates an exemplary embodiment of a vacuum cleaner operating in a vacuum cleaning mode, in which the vacuum cleaner is used for vacuum cleaning, while FIG. 3*b* illustrates the vacuum cleaner when switched to a filter cleaning mode. In this embodiment, the vacuum cleaner has a first and a second sub-separator that are connected in parallel in the vacuum cleaning mode, and in series in the filter cleaning mode.

With reference to both FIG. 3*a* and FIG. 3*b*, the vacuum cleaner has a vacuum source 31, typically comprising a fan driven by an electric motor. The vacuum source 31 creates a negative air pressure which makes the vacuum cleaner capable of collecting dust from floors and carpets, etc. The vacuum source 31 is connected, via a downstream filter 33, to a separating unit 34 which comprises a first 35 and a second 37 sub-separator. The first and second sub-separators 35, 37 are connected in parallel in the vacuum cleaning mode, such that they may each receive substantially half (50%) of a dust laden airflow 39, which is received through an inlet 41, which may typically be connected to a flexible tube 7, such as shown in FIG. 1. Of course it is possible to let the sub-separators receive different amounts of air (e.g. 60%/40%, 70%/30%, etc.). It would also be possible to use three or more sub-separators connected in parallel. Each sub-separator may comprise a cyclone separator. Further the sub-separators may comprise several cyclone separators of equal or different vortex diameter. The several cyclones of each sub-separator may be connected in series and/or in parallel.

The sub-separators 35, 37 separate most of the dust from the airstream 39. Any remaining dust is filtered by the downstream filter 33, through which the airstream passes in a forward direction, in order to protect the vacuum source 31 from the remaining dust, which typically consists of finer dust fractions. The airstream then passes through the vacuum source 31, and is finally filtered by a motor filter 43 to separate, for example, graphite particles released by the vacuum source 31. The configuration of FIG. 3*a* is accomplished by keeping a first set of valves 45, 47, 49, 51, 53 open, while a second set of valves 55, 57, 59, 61 are closed.

As the sub-separators are connected in parallel in the vacuum cleaning mode, the flow resistance of the separating unit in this case is low. This provides efficient collection of dust from carpets, floors, etc.

In FIG. 3*b*, the vacuum cleaner has been switched to a filter cleaning mode. In the filter cleaning mode, the downstream filter 33 is cleaned such that its flow resistance may be reduced by removing dust that may otherwise clog the filter. The vacuum cleaner is switched to the filter cleaning mode by closing the first set of valves 45, 47, 49, 51, 53 and opening the second set of valves 55, 57, 59, 61. Then an ambient air airstream 63 is drawn through a filter cleaning opening 65 and passes through the downstream filter 33 in a reverse direction, such that the downstream filter may release dust into the airstream 63. This process may optionally be enhanced by means of a rapper or vibrator 67, which vibrates or raps the downstream filter 33.

Note that the layout of FIGS. 3*a* and 3*b* is only a schematic example. Other layouts are possible within the scope of the present disclosure and the functions of the valves may be achieved differently.

In FIG. 3*b*, an ambient air stream 63 is drawn through a filter cleaning opening 65. However, it is also possible to dispense with the filter cleaning opening 65 and to direct ambient air from the inlet 41 to the downstream filter 33 such that the air stream will pass the downstream filter 33 in a reversed direction. It would also be possible to shut all air inlets of the vacuum cleaner during the filter cleaning mode and to force air, which is already inside the vacuum cleaner, through the downstream filter 33 in the reversed direction.

The airstream then passes through the first sub-separator 35 and through the second sub-separator 37, which are now series connected, such that the released dust is again separated from the airstream. The airstream then passes through the vacuum source 31 and the motor filter.

The use of two series connected sub-separators in the filter cleaning mode may allow cleaning of a clogged downstream filter without the use of another downstream filter, as the series connected separator configuration can have a much better separation performance. This configuration may be used, since a much higher separator flow resistance may be allowed in the filter cleaning mode. Thus, unlike in some prior art devices as described previously herein, the auxiliary filter need not be moved every time the filter is cleaned, and the process may be simpler from the user's point of view. It may even be carried out automatically.

Figure 4B:
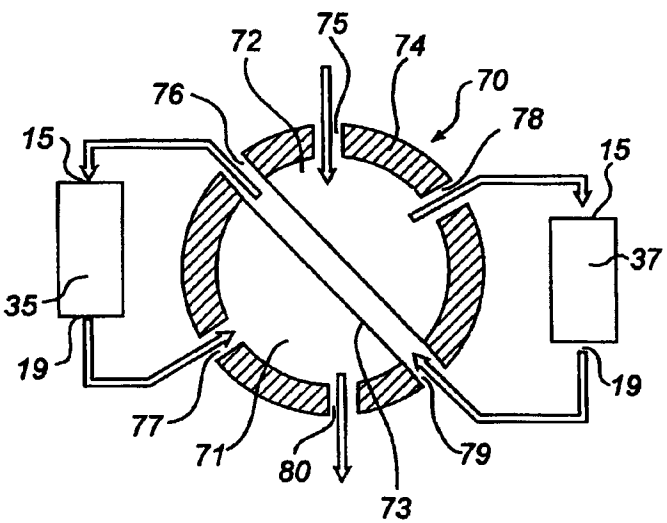
FIGS. 4*a* and 4*b* schematically illustrate a valve for switching between the vacuum cleaning mode and the filter cleaning mode.
Figure 4A:
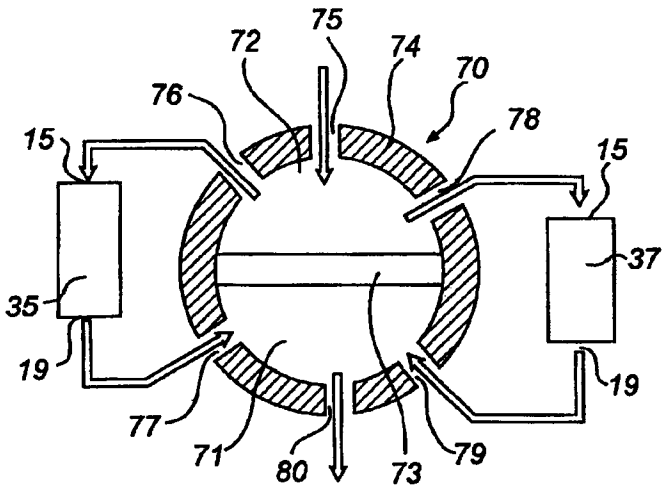

In FIGS. 4*a* and 4*b*, an exemplary embodiment of a valve 70 for changing the connection of the sub-separators between a parallel and a serial when switching between the vacuum cleaning mode and the filter cleaning mode is shown. In the shown embodiment, each sub-separator comprises a cyclone separator, however, the skilled person realizes that also other kinds of sub-separators could be used. The cyclone separators can be of the type described above with reference to FIG. 2 and may comprise an inlet slot 15, a vortex chamber, an outlet tube 19 and an opening 25 in the bottom part for separated dust.

The valve 70 comprises a valve chamber, which is enclosed by a valve housing. The valve housing includes cylindrical wall portion 74. A cross wall 73 is arranged across the valve chamber such that the chamber is divided into two compartments 71, 72, wherein the compartments 71, 72 are sealed from each other by the cross wall 73 in an air tight manner. An air channel is provided in the cross wall, wherein the air channel extends from one end of the cross wall 73 to the other end of the cross wall 73. The cross wall 73 is rotatably arranged inside the valve chamber, wherein the cross wall 73 is in sliding contact with the inner side of the cylindrical wall portion 74 in order to keep the air tight seal between the compartments 71, 72.

The cylindrical wall portion 74 of the valve housing is provided with six air openings for leading an air stream in and out of the valve chamber. An air stream is fed to the valve 70 through a main entrance opening 75 and is released through a main outlet 80. Furthermore, a left outlet 76 is connected to the inlet 15 of a first sub-separator 35, and a left inlet 77 in connected to the outlet 19 of the fist sub-separator 35. Finally, a right outlet 78 is connected to the inlet 15 of a second sub-separator 37, and a right inlet 79 in connected to the outlet 19 of the second sub-separator 37.

In FIG. 4*a* the valve is shown in a position where the sub-separators are connected in parallel for operating the vacuum cleaner in a vacuum cleaning mode. The cross wall is positioned such that it extends from the cylindrical wall portion 74 at a location between the left outlet 76 and the left inlet 77 to a diametrically opposite location at the cylindrical wall portion 74 between the right outlet 78 and the right inlet 79. Thus, when a dust laden air stream enters the valve 70, it is received in the compartment 72 and is allowed to continue through both the right and the left outlets 76, 78 to both sub-separators 35,37. The two air streams leaving the sub-separators are fed back to the valve chamber where they enter the compartment 71 through the left and right inlets 77, 79, respectively. Finally, a reunited air stream leaves the valve through the main outlet 80. Thereafter the air stream continues to the downstream filter (not shown) and further through the vacuum cleaner as described above with reference to FIGS. 1-3.

When the vacuum cleaner is switched to filter cleaning mode, the valve 70 is operated to rotate the cross wall 73 to the position shown in FIG. 4*b*, whereby the sub-separators 35, 37 become connected in series. The cross wall 73 is positioned such that the air channel thereof connects the right inlet 79 with the left outlet 76. Thus, when an air stream, which is laden with dust released from the down stream filter (not shown), arrives at the valve 70, it is fed into the compartment 72 through the main entrance opening 75. Thereafter, the air stream passes through the right outlet 78, through the second sub-separator 37, through the air channel of the cross wall 73, through the first sub-separator 35 and is finally received in compartment 71 of the valve chamber. Thereafter, the air stream leaves the valve chamber through the main outlet 80 and continuous to vacuum source (not shown) as described above with reference to FIGS. 1-3.

The process described with reference to FIGS. 3*a* and 3*b* above cleans the downstream filter 33, such that it does not need to be replaced very often. As the sub-separators are now series connected, their separation ratio for a given dust (e.g., a standard dust) will be much higher than in the vacuum cleaning mode, which means that an additional downstream filter may not be needed, even though such a filter may optionally be provided. The higher separation ratio comes at the cost of a higher flow resistance, but in the filter cleaning mode this may be allowed, as there is no need to collect dust comprising heavier particles from a floor or carpet. This higher separation ratio makes it possible to efficiently separate the fine dust fractions released from the downstream filter.

The downstream filter 33 in this configuration may be cleaned regularly, either manually or automatically, for example, when the user begins or finishes a vacuum cleaning. It is also possible to provide a pressure sensor that measures the pressure drop over the downstream filter in order to determine when filter cleaning is needed. The duration in which the vacuum cleaner is in the filter cleaning mode, or in other words, how long the filter is subjected to filter cleaning, can be a fixed time, decided on manually, or depend on the pressure drop over the filter, for example.

Thus the downstream filter need not be able to carry a lot of dust, since it may be cleaned regularly, and thus micro pore filters such as filters made of expanded PTFE (polytetrafluoroethylene), e.g. GORE-TEX (trademark) may be considered for use in some embodiments. On such filters the dust is collected on top of the filter surface, rather than in the depth of the filter as in a conventional filter. A micro pore filter may therefore be easily cleaned.

The foregoing exemplary embodiment provides a vacuum cleaner comprising a separating unit, a vacuum source for creating a negative air pressure, and a downstream filter. The vacuum cleaner is configured to operate in a vacuum cleaning mode, and is switchable to a filter cleaning mode, wherein the vacuum source is connected to the downstream filter to force an airstream therethrough in a reverse direction in order to remove dust from the downstream filter, and the separating unit is arranged to separate dust, released by the downstream filter, from the airstream. The separating unit has first and second sub-separators, which are connected in parallel in the vacuum cleaning mode, and are connected in series in the filter cleaning mode. This provides convenient cleaning of the downstream filter.

The invention is not restricted to the described embodiments, and may be varied and altered without departing from the scope of the appended claims. For example, the invention may be used in vacuum cleaners of types other than the shown canister vacuum cleaner, such as a stationary vacuum cleaner or a moveable vacuum cleaner of the upright type.

The invention claimed is:

1. A vacuum cleaner comprising:

a vacuum source adapted to generate an airstream, the vacuum source having a vacuum source inlet and a vacuum source outlet;

a filter having a front side and a back side;

a separating unit comprising a first sub-separator having a first sub-separator inlet and a first sub-separator outlet, and a second sub-separator having a second sub-separator inlet and a second sub-separator outlet;

a dirty air inlet associated with an inlet nozzle;

airflow passages connecting the vacuum source, the filter and the separating unit in a first configuration corresponding to a vacuum cleaning mode and a second configuration corresponding to a filter cleaning mode, wherein:

in the vacuum cleaning mode, the airflow passages connect the dirty air inlet in parallel to the first sub-separator inlet and the second sub-separator inlet, connect the first sub-separator outlet and the second sub-separator outlet in parallel to the filter front side, and connect the filter back side to the vacuum source inlet, and in the filter cleaning mode, the airflow passages connect the filter front side to the first sub-separator inlet, connect the first sub-separator outlet to the second sub-separator inlet, and connect the second sub-separator outlet to the vacuum source inlet.

2. The vacuum cleaner of claim 1, further comprising an ambient air inlet, wherein in the filter cleaning mode the airflow passages connect the ambient air inlet to the back side of the filter.

3. The vacuum cleaner of claim 1, wherein at least one of the first sub-separator and the second sub-separator comprises a cyclone separator.

4. The vacuum cleaner of claim 3, wherein the first sub-separator and the second sub-separator each comprise a cyclone separator.

5. The vacuum cleaner of claim 1, wherein the filter comprises a micro pore filter.

6. The vacuum cleaner of claim 1, wherein the vacuum cleaner is one of the set consisting of a stationary vacuum cleaner, a canister vacuum cleaner, and an upright vacuum cleaner and further comprises a main body in which the vacuum source is disposed.

7. The vacuum cleaner of claim 1, further comprising one or more valves adapted to selectively connect the airflow passages in the vacuum cleaning mode or the filter cleaning mode.

8. The vacuum cleaner of claim 7, wherein the one or more valves comprise a valve comprising:

a wall portion;

a first opening through the wall portion associated with the dirty air inlet;

a second opening through the wall portion associated with the first sub-separator inlet;

a third opening through the wall portion associated with the second sub-separator inlet;

a fourth opening through the wall portion associated with the first sub-separator outlet;

a fifth opening through the wall portion associated with the second sub-separator outlet;

a sixth opening through the wall portion associated with the front side of the filter; and a cross wall movably mounted within the wall portion and having a connecting passage therethrough; wherein the cross wall is selectively movable between:

a first position, corresponding to the vacuum cleaning mode, in which the first, second and third openings are in fluid communication with one another within the wall portion, the fourth, fifth and sixth openings are in fluid communication with one another within the wall portion, and a second position, corresponding to the filter cleaning mode, in which the first and third openings are in fluid communication with one another within the wall portion, the fifth and second openings are in fluid communication with one another via the connecting passage, and the fourth and sixth openings are in fluid communication with one another within the wall portion.

9. A method for operating a vacuum cleaner comprising a first sub-separator, a second sub-separator and a filter, the method comprising:

in a first mode of operation, passing a first airstream through the first sub-separator and the second sub-separator in parallel to separate a first amount of dust from the first airstream, and passing the air stream leaving the first sub-separator and the second sub-separator through the filter in a forward direction for filtering a second amount of dust from the air stream; and, in a second mode of operation, passing a second airstream through the filter in a backwards direction to remove a third amount of dust from the filter, then passing the second airstream through the first sub-separator and then the second sub-separator in series to remove a fourth amount of dust from the second airstream.

* * * * *